United States Patent [19]

Armstrong

[11] Patent Number: 4,669,625

[45] Date of Patent: Jun. 2, 1987

[54] EASY OPENING LID

[75] Inventor: James A. Armstrong, Woodbury, N.Y.

[73] Assignee: Garsite Products, Inc., Deer Park, N.Y.

[21] Appl. No.: 857,654

[22] Filed: Apr. 29, 1986

[51] Int. Cl.[4] ..... B65D 25/24

[52] U.S. Cl. ..... 220/18; 220/334; 220/260; 49/379; 49/387

[58] Field of Search ..... 220/260, 18, 334, 335; 49/379, 387, 33; 114/201 R; 16/1 R

[56] References Cited

U.S. PATENT DOCUMENTS

| | | | |
|---|---|---|---|
| 402,932 | 5/1889 | Jolly . | |
| 762,741 | 6/1904 | Moos . | |
| 1,081,871 | 12/1913 | Solomon . | |
| 1,115,554 | 11/1914 | Leonhard . | |
| 1,617,680 | 2/1927 | Funcheon . | |
| 3,190,039 | 6/1965 | Carlson | 220/18 |
| 3,541,727 | 11/1970 | Carlson | 220/18 |
| 4,065,020 | 12/1977 | Carlson | 220/18 |
| 4,467,932 | 8/1984 | Dabich . | |

*Primary Examiner*—George T. Hall
*Attorney, Agent, or Firm*—Nolte, Nolte and Hunter

[57] ABSTRACT

A simple, compact counterweight mechanism for a lid for a sub-surface container. A straight rigid beam extends from front to rear within the container. Front portions of the beam are connected to the overlying lid, middle portions of the beam are pivotally connected to the container and rear portions of the beam are pivotally connected to a pair of rearwardly extending control arms, which are pivotally connected at their rear to a depending counterweight. A compression spring is mounted on the beam beneath the control arms, so that as the front of the lid is lifted to open the lid and pivot the lid and the front portions of the beam upwardly and rearwardly about the middle portions of the beam and pivot the rear portions of the beam, together with the control arms and the counterweight, downwardly and frontally about the middle portions of the beam, the spring keeps the pivotal connection of the counterweight and the control arms, together with the vertically aligned center of gravity of the counterweight, located rearwardly of the pivotal connection of the middle portions of the beam and the container.

7 Claims, 4 Drawing Figures

EASY OPENING LID

BACKGROUND OF THE INVENTION

This invention relates to a lid which is counterweighted to make it easy to open. This invention particularly relates to an access lid for a sub-surface container provided with a counterweight mechanism that is easy to maintain and repair and requires only a minimum amount of space in the container but allows the lid to be opened easily to a fully upright position.

Lids provided with counterweight mechanisms to make them easier to open are well known. See, for example, U.S. Pat. Nos. 402,932, 762,741 and 1,115,554. Especially designed counter weight mechanisms for the heavy access lids of sub-surface containers, such as pits designed for use in servicing aircraft, are also well known. See, for example, U.S. Pat. No. 4,467,932. However, numerous problems have been encountered with such counterweight mechanisms. For example, such mechanisms have typically required relatively large amounts of space for their connections to their lids and for the travel of their counterweights when opening and closing their lids. This has often made it impractical to use such mechanisms in crowded sub-surface containers where space has been at a premium. Such counterweight mechanisms have also typically had to be connected to their lids using relatively complicated mechanical means (e.g., meshed gearing). This has often made such mechanisms difficult to maintain and repair when they have been used in sub-surface containers exposed to harsh environments and to substantial amounts of dirt and grit that can damage their mechanical connections to their lids.

There has been a need, therefore, for a simple counterweight mechanism for an access lid for a sub-surface container which requires only a minimum amount of space and is easy to maintain and repair.

SUMMARY OF THE INVENTION

In accordance with this invention, a simple counterweight mechanism for a lid for the top of a container is provided which requires only a minimum amount of space and is easy to maintain and repair. The mechanism comprises:

a substantially straight, rigid beam which, when the lid is closed, extends longitudinally within the container with: (a) front portions of the beam underlying, and being connected to, the lid and (b) rear portions of the beam being located rearwardly of the lid; the beam being pivotally connected to the container about a laterally extending axis between the front and rear portions of the beam and rearwardly of the lid, so that as the front of the lid is lifted upwardly to open the lid, the lid and the front portions of the beam pivot together upwardly and rearwardly about the pivotal connection of the beam and container and the rear portions of the beam pivot downwardly and frontally about the pivotal connection of the beam and container;

a counterweight; and means for pivotally connecting the counterweight to the rear portions of the beam, so that the counterweight can pivot rearwardly, about a laterally extending axis rearwardly of the pivotal connection of the beam and container, with downward and frontal pivoting of the rear portions of the beam and the counterweight about the pivotal connection of the beam and container.

In accordance with a preferred embodiment of this invention, said means for pivotally connecting the counterweight to the rear portions of the beam comprises:

a substantially straight, rigid control arm which extends longitudinally within the container with: (a) front portions of the control arm being pivotally connected to the rear portions of the beam about a laterally extending axis, so that the control arm can pivot frontally and rearwardly about its pivotal connection to the beam and (b) rear portions of the control arm being pivotally connected to the counterweight about a laterally extending axis, so that the counterweight can pivot frontally and rearwardly about its pivotal connection to the control arm and about the rear portions of the beam;

a rigid support member connected to the beam and underlying the control arm when the lid is closed; and means connected to the support member and the control arm for urging apart the support member and the rear portions of the control arm, so that as the front of the lid is lifted upwardly to open the lid, the pivotal connection of the counterweight to the rear portions of the control arm is kept by said urging means located rearwardly of the pivotal connection of the beam and container.

DETAILED DESCRIPTION OF THE PREFERRED EMBODIMENT

Figure 1:
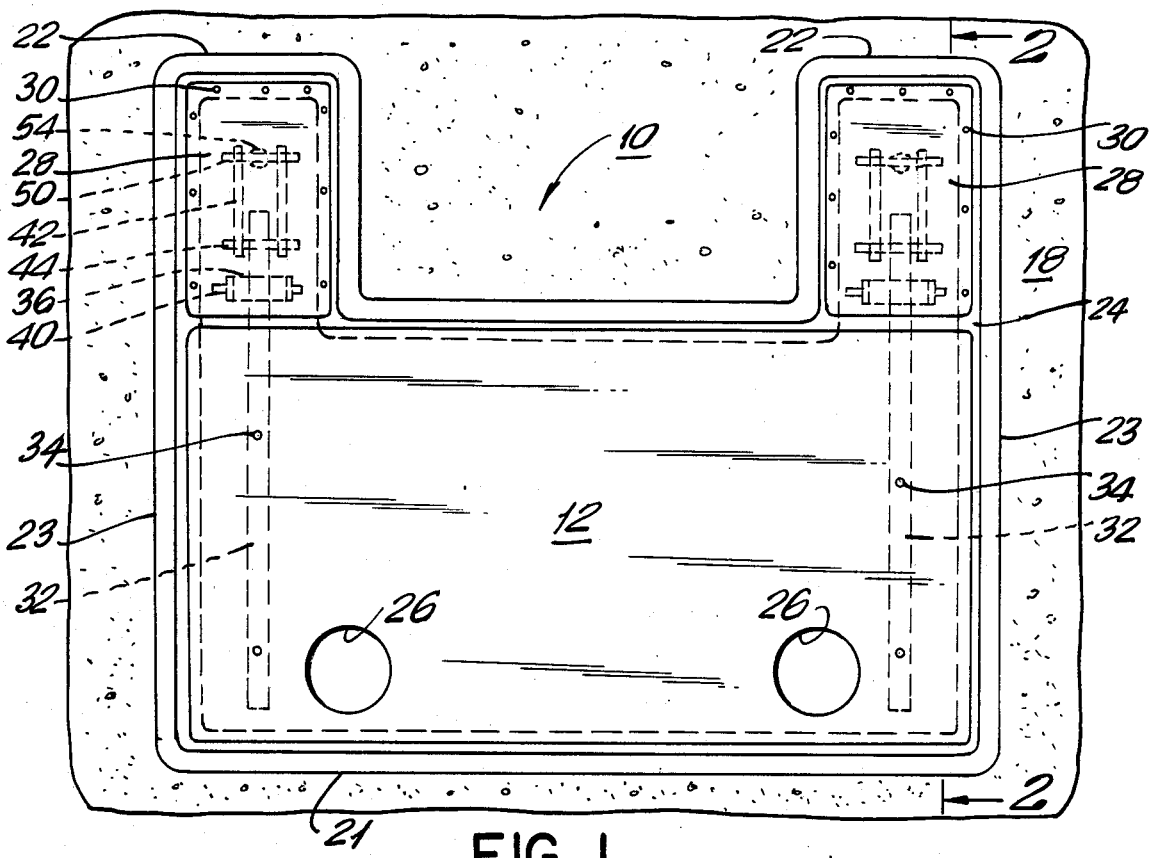
FIG. 1 is a schematic top plan view of a counterweighted access lid in accordance with this invention. The lid is pivotally mounted on top of a pre-fabricated pit buried in the ground.

FIGS. 1-4 schematically show a prefabricated subsurface pit, generally 10. On top of the pit 10 is a generally rectangular access lid or cover, generally 12. The lid 12, when closed as in FIGS. 2 and 4, extends longitudinally from the front of the pit 10 towards its rear and laterally between its sides. Within the pit 10 are one or more, preferably a pair of, counterweight mechanisms of this invention, generally 14, that are connected to the bottom of the lid 12 and are preferably symmetrical about the longitudinal axis of the lid. The pit 10 is installed in a suitably excavated hole 16 in the ground below a paved (e.g., tarmac) surface 18 such as is found in a conventional aircraft docking area. Preferably, the top of the pit 10 is substantially coplanar with the paved surface 18. The pit 10 can be a conventional rigid metal or plastic (e.g., fiberglass) container for holding valves, junction boxes, fuel and air lines, etc. (not shown) for servicing aircraft, and its access lid 12 can be a conventional heavy-duty metal (e.g., steel or aluminium) lid which can support the weight of an aircraft on top of it when the lid is closed on the pit 10.

Figure 2:
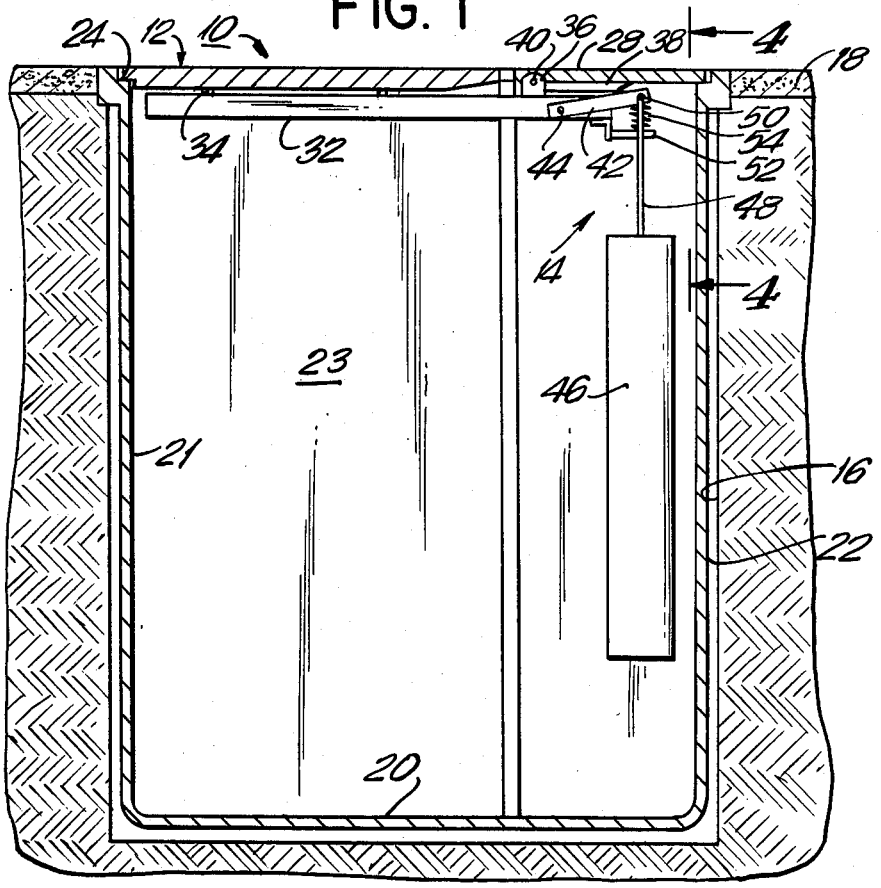
FIG. 2 is a side sectional view taken longitudinally along line 2—2 in FIG. 1, showing the lid on the pit in its closed horizontal position, approximately flush with the ground and the top of the pit. A counterweight mechanism of this invention is mounted on the bottom of the lid, with its counterweight at the rear of the pit.
Figure 3:
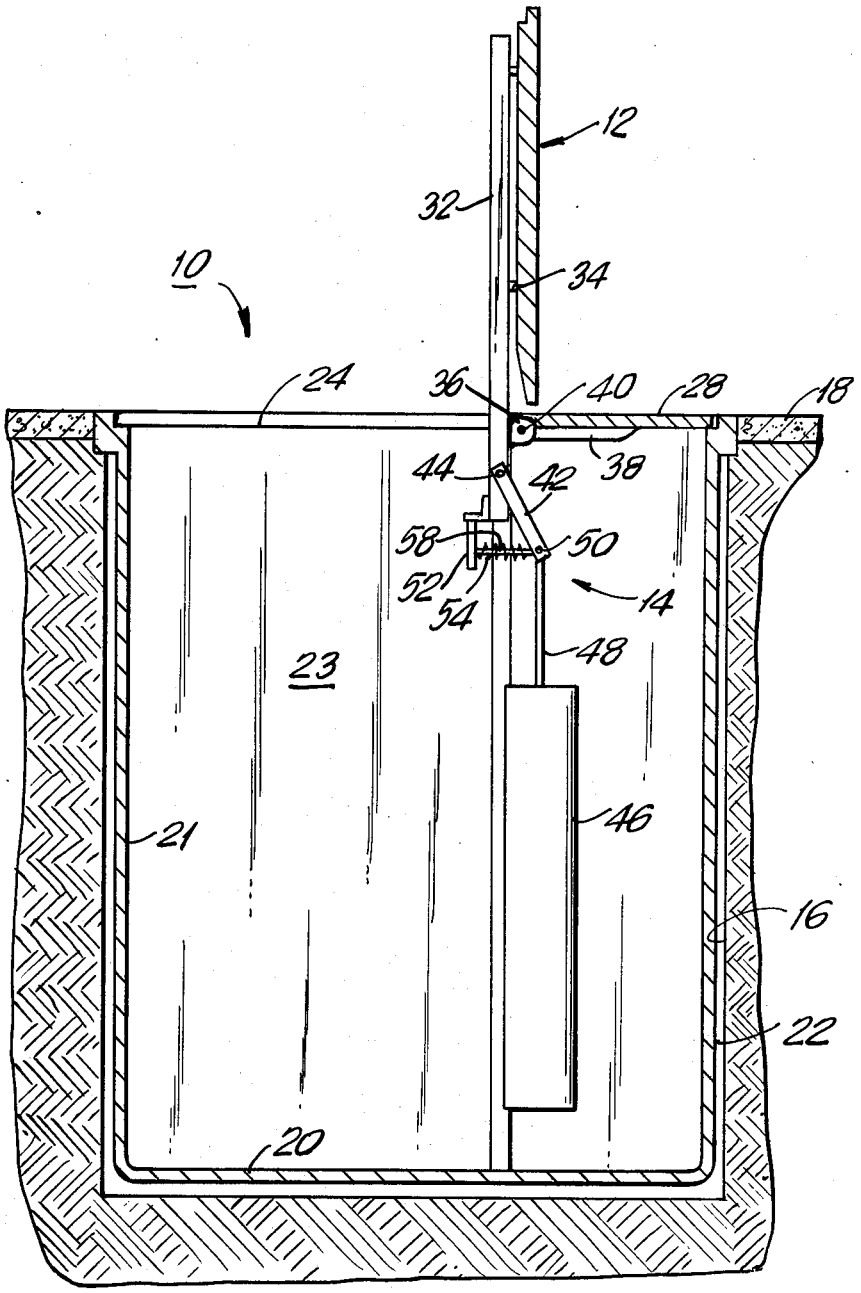
FIG. 3 is a side sectional view, similar to FIG. 2, showing the lid in its fully open position, upright on top of the pit. The counterweight mechanism has rotated 90° with the lid about a common pivot, and its counterweight has moved frontally in the pit to a position to the rear of the common pivot.

As best shown in FIGS. 2 and 3, the pit 10 comprises a bottom wall 20 and an upstanding front wall 21, an upstanding rear wall 22 and a pair of upstanding side walls 23 which surround the bottom wall 20. A substantially horizontal flange 24 on top of the front, rear and side walls 21–23 supports the lid 12 and its counterweight mechanisms 14 on top of the pit 10 as described below.

As shown in FIG. 2, the access lid 12, when closed, covers the front portions of the pit 10 and lies substantially horizontally atop the flange 24 on the front wall 21 and on the front portions of the side walls 23. Preferably, the top of the lid 12, when closed, is substantially coplanar with the top of the pit and the surrounding paved surface 18. The lid 12 is adapted to be opened by lifting its front upwardly off of the flange 24 on top of the front wall 21 so that the lid pivots upwardly and rearwardly about its rear from a substantially horizontal position as shown in FIG. 2 to a substantially upright or vertical position as shown in FIG. 3. In this regard, hand holes 26 are preferably provided near the front of the lid 12 to facilitate grasping and lifting the front of the lid 12. Preferably, a stop mechanism (not shown) is provided on the lid 12 to prevent it from being opened beyond its substantially upright position.

Located on the rear portions of the pit 10, to the rear of the lid 12, are one or more, preferably a pair of, generally rectangular counterweight covers 28 having the same heavy-duty (e.g., steel) construction as the lid 12. As shown in FIGS. 1–3, each counterweight cover 28 overlies one of the counterweight mechanisms 14 and lies substantially horizontally atop the flange 24 on the rear wall 22 and on the rear portions of at least one of the side walls 23. The counterweight covers 28 are held in place on the flange 24 in a conventional manner, for example by means of a plurality of removable bolts 30 extending vertically through the counterweight covers 28 and the flange 24. Preferably, both sides and the rear of each counterweight cover 28 are held on the flange 24 by the bolts 30, and the top of each counterweight cover is substantially coplanar with the top of the lid 12, when closed.

Figure 4:
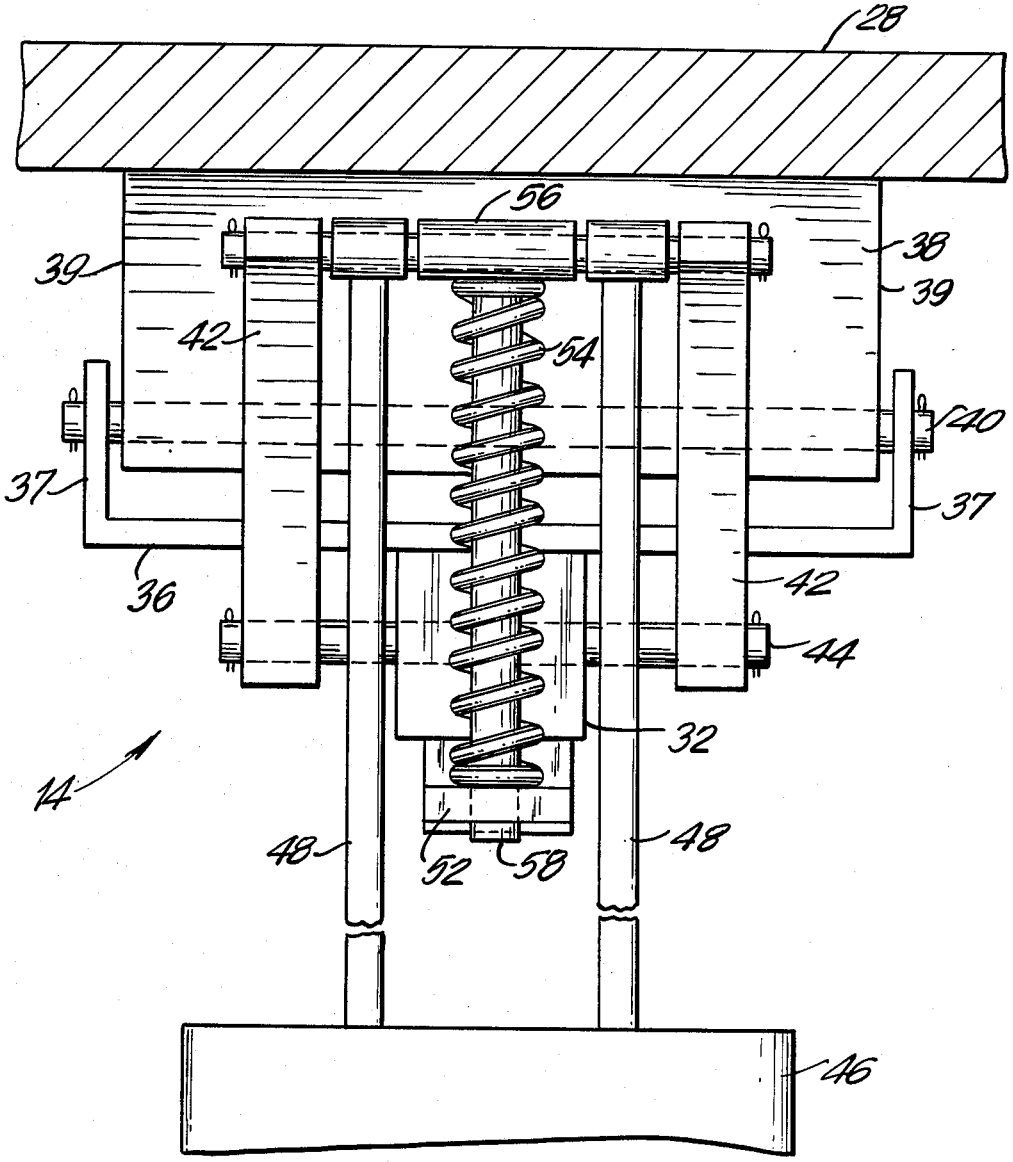
FIG. 4 is a detailed sectional view taken laterally along line 4—4 in FIG. 2, showing the rear of the counterweight mechanism when its lid is closed.

As shown in FIGS. 2–4, the pair of counterweight mechanisms 14 of this invention each comprise a substantially straight, rigid beam 32. When the access lid 12 is closed as in FIGS. 2 and 4, each beam 32 extends rearwardly within the pit 10 beneath the lid 12 and one of the counterweight covers 28 from about the front of the lid 12 to about the middle of its overlying counterweight cover 28. Preferably, each beam 32 extends rearwardly along the longitudinal center line of its overlying counterweight cover 28. Front portions of each beam 32 are connected to the overlying portions of the lid 12 with a plurality of removable bolts 34 that extend vertically through the lid and the front portions of the beam so as to fasten them together securely. Each beam 32 is also pivotally connected about a laterally extending axis to front portions of its overlying counterweight cover 28. In this regard, an upwardly extending bracket 36 is mounted on top of the beam 32 rearwardly of the lid 12 and is hingedly connected to a downwardly extending projection 38 on the bottom of the counterweight cover 28, adjacent the front thereof. As best shown in FIG. 4, the bracket 36 on each beam 32 is preferably bifurcated with arms 37 which extend upwardly about the sides 39 of the projection 38 on the bottom of its counterweight cover 28, and a first pivot pin 40 preferably extends sideways through the sides 39 of the projection 38 and the upwardly extending arms 37 of the bracket 36. Thereby, the front portions of the beam 32, together with the lid 12, can rotate rearwardly and frontally about the first pivot pin 40 and relative to the front of the counterweight cover 28 and the rear of the lid 12 when opening and closing the lid. It is preferred that each first pivot pin 40 be located closer to the front of its counterweight cover 28 than to the top of its beam 32, so that the front portions of the beam and the lid can rotate rearwardly about 90° about the first pivot pin in order to open fully the lid to its position in FIG. 3.

As also seen from FIGS. 2–4, each counterweight mechanism 14 has one or more, preferably a pair of, substantially straight, rigid control arms 42 connected to, and extending rearwardly of, its beam 32 within the pit 10. Front portions of each control arm 42 are pivotally connected about a laterally extending axis to rear portions of its beam 32 rearwardly of the bracket 36 on the beam. Preferably, a pair of the control arms 42 are located on laterally opposite sides of the beam 32, and a second pivot pin 44 extends sideways through the front portions of the control arms 42 and the rear portions of the beam 32, so that rear portions of the control arms, located rearwardly of the beam 32, can rotate frontally and rearwardly about the second pivot pin 44 and relative to the rear portions of the beam 32 when opening and closing the lid 12.

As further seen from FIGS. 2–4, each counterweight mechanism 14 has at least one counterweight 46 connected to, and depending from, rear portions of its control arms 42, so that the counterweight 46 rotates frontally and rearwardly with the rear portions of the beam 32 and the control arms 42 about the first pivot pin 40 when opening and closing the lid 12. The weight of the counterweight 46 and its vertical position relative to the rear portions of its control arms 42 are not critical, but it is preferred that the counterweight 46 be adapted so that its weight and its vertical position beneath the rear portions of the control arms can be varied depending upon the weight of the lid 12, the dimensions of the pit 10 and the desired force to lift the front of the lid to open it. Preferably, the top of each counterweight 46 is pivotally connected about a laterally extending axis to the rear portions of its control arms 42. In this regard, the top of each counterweight 46 is preferably provided with one or more, preferably a pair of, upstanding side-by-side support arms 48 between the control arms 42, and a third pivot pin 50 extends sideways through the rear portions of the control arms 42 and the top portions of the support arms 48, so that the support arms 48 and counterweight 46 can also rotate frontally and rearwardly about the third pivot pin 50 and relative to the rear portions of the beam 32 and the control arms 42 when the lid 12 is opened and closed.

Mounted on the bottom of the rear portions of the beam 32 of each counterweight mechanism 14, beneath the control arms 42, is a substantially straight, rigid support member 52. When the access lid 12 is closed as in FIGS. 2 and 4, the support member 52 extends rearwardly of its beam 32 between its pair of control arms 42 and between the pair of support arms 48 connected to the control arms 42, so that the rear portions of the support member 52 underlie the third pivot pin 50. Mounted on the support member 52 is one axial end of a compression spring 54, preferably a coil spring. The other axial end of the spring 54 is mounted on a cylindrical sleeve 56 which extends sideways and surrounds the third pivot pin 50 between the pair of control arms 42 and between the pair of support arms 48 for the counterweight 46. Thereby, the spring 54 can rotate frontally and rearwardly about the third pivot pin 50 relative to the rear portions of the control arms 42 and the top portions of the support arms 48 when the lid 12 is opened and closed. Preferably, a rigid spring retaining rod 58 extends axially through the spring 54. One end of the spring retaining rod 58 is mounted on the sleeve 56, and the other end of the rod 58 is free and extends through a bushing (not shown) in the support member 52. This allows the free end of the rod 58 to move through the support member 52 as the distance changes between the support member 52 and the sleeve 56, causing the compression of the spring 54 to change, during operation of the counterweight mechanism 14 of this invention when the lid 12 is opened and closed as described below.

The pair of counterweight mechanisms 14 mounted beneath the access lid 12 make it easy to open the lid from its closed position as shown in FIGS. 2 and 4, wherein the lid and each beam 32 are substantially horizontal and are located within the pit 10, to the lid's fully open position as shown in FIG. 3, wherein the lid and the front portions of each beam extend vertically upward and outward of the pit. In opening the lid 12, the hand holes 26 therein can be grasped and lifted upwardly, so that the front of the lid is lifted off of the flange 24 on top of the front wall 21 of the pit 10. Lifting the front of the lid 12 also lifts the front portions of each beam 32, and this causes each beam and the upstanding pair of arms 37 on the bracket 36 atop each beam to pivot about the first pivot pin 40, extending through the bracket arms 37 and through the bottom projection 38 on the counterweight cover 28 overlying and supporting each beam. As a result, the lid 12 and the front portions of each beam 32 pivot upwardly and rearwardly about the first pivot pin 40, and the rear portions of each beam 32, together with each control arm 42, counterweight 46, support arm 48 and spring 54 thereon, pivot downwardly and frontally about the first pivot pin 40 from their positions as shown in FIG. 2 to their positions as shown in FIG. 3. In accordance with this invention, lifting the front of the lid 12 to open it also results in each counterweight 46 and its support arms 48 pivoting rearwardly about their third pivot pin 50, so that the support arms 48 remain substantially vertical during opening of the lid and the third pivot pin 50, the support arms 48 and the center of gravity of the counterweight 46 remain vertically aligned.

Also in accordance with this invention, the downward forces exerted by the counterweight 46 on the spring 54 and support member 52 of each counterweight mechanism 14 decrease significantly as the lid 12 is opened, from the full weight of the counterweight 46 compressing the spring 54 and bearing against the support member 52 when the lid 12 is closed (as in FIG. 2) to only part of the weight of the counterweight 46 compressing the spring 54 and bearing on the support member 52 when the lid 12 is open (as in FIG. 3). As a result, the spring 54 becomes significantly less compressed as the lid 12 is opened, and the spring 54 can urge the third pivot pin 50, the rear portions of the control arms 42 and the top portions of the support arms 48 away from the support member 52 as the lid 12 is opened, so that the acute angle between the rear portions of each beam 32 and each of its control arms 42 increases significantly as the lid 12 is opened. Thereby when the lid 12 is fully opened to a position in which the lid and the beam 32 are substantially vertical (as in FIG. 3), the vertically aligned third pivot pin 50, support arms 48 and center of gravity of the counterweight 46 of each counterweight mechanism 14 are kept rearwardly of the first pivot pin 40 by the spring 54, and the counterweight serves continuously to counterbalance movement of the lid 12 about the first pivot pin 40—even when the lid 12 is moved to its fully open, substantially vertical position. Thus, the counterweight mechanism 14 of this invention is effective for facilitating the opening and closing of the lid 12 over the full 90° travel of the lid 12 between its fully closed position as shown in FIG. 2 and its fully open position as shown in FIG. 3.

It is thought that this invention and many of its attendant advantages will be understood from the foregoing description, and it will be apparent that various changes and modifications can be made in the invention without departing from the spirit and scope thereof or sacrificing all of its material advantages, the counterweight mechanism 14 hereinbefore described being merely a preferred embodiment. In this regard, terms such as "front", "rear", "side", "top", "bottom", "longitudinal", "lateral", "horizontal" and "vertical" are simply relative terms used to describe the pit 10 and its counterweight mechanism 14 of this invention as shown in FIGS. 1–4 and claimed hereinafter.

I claim:

1. A counterweight mechanism for a lid for the top of a container, comprising:

a substantially straight, rigid beam which, when the lid is closed, extends longitudinally within the container with: (a) front portions of the beam underlying, and being connected to, the lid and (b) rear portions of the beam being located rearwardly of the lid; the beam being pivotally connected to the container about a laterally extending axis between the front and rear portions of the beam and rearwardly of the lid, so that as the front of the lid is lifted upwardly to open the lid, the lid and the front portions of the beam pivot together upwardly and rearwardly about the pivotal connection of the beam and container and the rear portions of the beam pivot downwardly and frontally about the pivotal connection of the beam and container;

a counterweight; and means pivotally connecting the counterweight to the rear portions of the beam, so that the counterweight can pivot rearwardly, about a laterally extending axis rearwardly of the pivotal connection of the beam and container, with downward and frontal pivoting of the rear portions of the beam and the counterweight about the pivotal connection of the beam and container.

2. The counterweight mechanism of claim 1, wherein the beam is pivotally connected to a cover located rearwardly of the lid and mounted on top of the container.

3. The counterweight mechanism of claim 2, wherein the beam is pivotally connected to the bottom of the cover adjacent the front thereof.

4. The counterweight mechanism of claim 1, wherein said means for pivotally connecting the counterweight to the rear portions of the beam comprises:

a substantially straight, rigid control arm which extends longitudinally within the container with: (a) front portions of the control arm being pivotally connected to the rear portions of the beam about a laterally extending axis, so that the control arm can pivot frontally and rearwardly about its pivotal connection to the beam and (b) rear portions of the control arm being pivotally connected to the counterweight about a laterally extending axis, so that the counterweight can pivot frontally and rearwardly about its pivotal connection to the control arm and about the rear portions of the beam;

a rigid support member connected to the beam and underlying the control arm when the lid is closed; and means connected to the support member and the control arm for urging apart the support member and the rear portions of the control arm, so that as the front of the lid is lifted upwardly to open the lid, the pivotal connection of the counterweight to the rear portions of the control arm is kept by said urging means located rearwardly of the pivotal connection of the beam and container.

5. The counterweight mechanism of claim 4, wherein said urging means comprises a compression spring between the rear portions of the control arm and rear portions of the support member.

6. The counterweight mechanism of claim 5, wherein a rigid spring retaining rod extends axially through the spring; one end of the rod being pivotally connected to the rear portions of the control arm and the counterweight about the laterally extending axis connecting them; the other end of the spring retaining rod extending through the support member and being adapted to move through the support member when the rear portions of the control arm are moved closer to the rear portions of the support member.

7. The counterweight mechanism of claim 6, wherein a pair of the control arms are located on laterally opposite sides of the beam, rear portions of the control arms are pivotally connected to the counterweight about a laterally extending axis, and the support member, when the lid is closed, extends rearwardly of the beam between the pair of control arms.

* * * * *